US006631780B1

(12) United States Patent
Hori et al.

(10) Patent No.: US 6,631,780 B1
(45) Date of Patent: Oct. 14, 2003

(54) ENGINE WITH TORQUE CONVERTER

(75) Inventors: Yoshiaki Hori, Saitama (JP); Tohru Nishi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 154 days.

(21) Appl. No.: 09/915,559

(22) Filed: Jul. 27, 2001

(30) Foreign Application Priority Data

Jul. 28, 2000 (JP) ..... 2000-228294

(51) Int. Cl.[7] ..... B60K 11/02
(52) U.S. Cl. ..... 180/292; 180/908
(58) Field of Search ..... 180/292, 291, 180/293, 908, 233; 123/196 R, 41.44, 196 AB

(56) References Cited

U.S. PATENT DOCUMENTS 4,736,809 A * 4/1988 Kumazawa ..... 180/75.1
6,024,193 A * 2/2000 Fukushima ..... 184/6.28
6,109,221 A * 8/2000 Higgins et al. ..... 123/41.47
6,305,342 B1 * 10/2001 Narita et al. ..... 123/196 R
6,314,934 B1 * 11/2001 Ito et al. ..... 123/196 R
6,318,333 B1 * 11/2001 Narita et al. ..... 123/196 R
6,332,444 B1 * 12/2001 Narita et al. ..... 123/196 R
6,484,607 B2 * 11/2002 Shichinohe et al.
6,499,443 B2 * 12/2002 Kawamoto et al. ..... 123/41.44

FOREIGN PATENT DOCUMENTS

JP 733763 4/1995

* cited by examiner

*Primary Examiner*—Brian L. Johnson
*Assistant Examiner*—Jeffrey Restifo
(74) *Attorney, Agent, or Firm*—Birch, Stewart, Kolasch & Birch, LLP

(57) ABSTRACT

In an engine with a torque converter for a saddle seat or buggy-type vehicle, a crankshaft and a shift drum placed approximately in parallel to a longitudinal direction of a vehicle are rotatably supported by a crankcase. The torque converter is provided on one end of an extension section of the crankshaft at an outer section of the crankcase. A double rotor type oil pump and a water pump are installed on the engine without enlarging a width of the engine. The lengths of piping to an oil cooler or radiator arranged in a front section of a vehicle body is made shortest. A part of the oil pump is overlapped with the shift drum and the torque converter, when viewed from the front of the engine. The oil pump is driven by chains from the crankshaft and is arranged in a space between an outer surface of the crankcase and the torque converter in a longitudinal direction. The water pump is coaxially connected to the oil pump and is provided on a side far from the torque converter when viewed from the center of the engine.

18 Claims, 10 Drawing Sheets

ENGINE WITH TORQUE CONVERTER

BACKGROUND OF THE INVENTION

1. Field of the Invention

The present invention relates to an engine with a torque converter, and more particularly, to an engine with a torque converter mounted on an all terrain saddle-seat vehicle.

2. Description of the Background Art

FIG. 6 to FIG. 8 are views of a first example of a conventional art. FIG. 6 is a front view of an engine for a conventional vehicle, illustrating an inner portion of the engine with the front case cover removed. FIG. 7 is a transverse cross section of a crankcase of the engine, viewed from the front, and illustrating the positions of respective rotation axes. FIG. 8 is a sectional view taken along line B—B of FIG. 7.

The engine is mounted on a vehicle via a mounting boss 008 so that respective rotation axes are approximately parallel to an advancing direction of the vehicle. In FIG. 6, reference numeral 003 denotes a front crankcase, and 004 denotes a rear crankcase, and the respective rotation axes are rotatably supported by these crankcases. Reference numeral 002 denotes a cylinder block coupled on the front and rear crankcases, which are integrally coupled with each other. Reference numeral 001 denotes a cylinder head coupled to the cylinder block 002. Reference numeral 020 denotes a crankshaft, 075 denotes a centrifugal start clutch provided on a front end of the crankshaft, 025 denotes a main shaft of a transmission, and 076 denotes a multi-disk type shift clutch provided on a front end of the main shaft. Reference numeral 028 denotes a drive shaft, and 040 denotes an oil pump.

In FIG. 7 (a transverse cross section of the crankcase, seen from the front), a crankshaft 020 extending along a traveling direction of a vehicle, viewed from the front, is arranged slightly biased on a left side from the center of the crankcase. The main shaft 025 and a countershaft 026 of the transmission are arranged in that order rightwardly of the crankshaft 020. A reverse shaft 027 is arranged above a mid-position between the main shaft 025 and the countershaft 026. The drive shaft 028 is arranged below the countershaft 026. These shafts are arranged parallel to the crankshaft 020, and rotatably supported on the front crankcase 003 and the rear crankcase 004.

A camshaft 029 driven by chains from the crankshaft 020 is arranged diagonally left of and above the crankshaft 020. A balance shaft 030 driven by gears from the crankshaft 020 is arranged below the camshaft 029. A shift drum 031 is arranged below the main shaft 025 and leftward of the drive shaft 028. The shift drum 031 is located at a central lower section inside the crankcase. The camshaft 029, balance shaft 030, and shift drum 031 are supported rotatably on the front crankcase 003 and the rear crankcase 004. Reference numeral 040 denotes an oil pump provided in front of the balance shaft 030.

FIG. 8 shows a sectional view taken on line B—B of FIG. 7. A left hand side in FIG. 8 shows a front portion of the engine, and a right hand side in FIG. 8 shows a rear portion of an engine. In FIG. 8, the oil pump 040 is directly connected to an end section of the balance shaft 030, and penetrates the front crankcase 003. The oil pump 040 is provided in front of the balance shaft 030 in front of the front crankcase 003. When the engine is in an operation state, the oil pump is integrally rotatably driven with the balance shaft 030, and feeds lubricating oil to an oil filter 056. The lubricating oil passed through the oil filter 056 is fed to a lubricating section of the engine and the transmission. Reference numeral 075 denotes the centrifugal type start clutch which is located in front of the crankshaft 020.

FIG. 9 and FIG. 10 are views of a Japanese Examined Patent Publication H7-33763, and relates to a second example of the conventional art. FIG. 9 is a longitudinal cross section of the crankcase of a V type engine for a motorcycle, seen from the side. FIG. 10 is a sectional view taken along line C—C of FIG. 9.

As shown in FIG. 9, a crankshaft 081, a main shaft 082, a countershaft 083, a drive shaft 084, and a shift drum 085 are arranged inside of a crankcase 080. The main shaft 082, countershaft 083, drive shaft 084, and shift drum 085 are arranged to constitute a transmission and a power transmission mechanism. All of these shaft groups are arranged in a direction perpendicular to an advancing direction of the vehicle. Reference numeral 090 denotes an oil pump provided at a position overlapping with the shift drum 085.

FIG. 10 is a transverse cross section of the crankcase, seen from the rear. In FIG. 10, reference numeral 080L denotes a left crankcase, and 080R denotes a right crankcase. FIG. 10 illustrates a state where both ends of the main shaft 082 are rotatably supported on the left and right crankcase 080L and 080R. One side surface 092 of a body 091 of the oil pump 090 is fixed to the right crankcase 080R by a bolt or the like (not illustrated). On the other side surface 093 of the body 091 of the oil pump 090, a bearing hole 094 is formed for rotatably supporting one end 086 of the shift drum 085. The other end 087 of the shift drum 085 is rotatably supported on the left crankcase 080L. A rotor 095 is installed inside the body 091 of the oil pump 090, and an oil pump shaft 096 is connected to the rotor 095. The oil pump shaft 096 penetrates the right crankcase 080R and protrudes to an outer section. A driven gear 097 is provided at the end section of the oil pump shaft 096. One end of the main shaft 082 penetrates the right crankcase 080R and protrudes to an outer section thereof. At an end section of the main shaft 082, a drive gear 088 is meshed with the driven gear 097 of the oil pump shaft 096. The oil pump 090 is driven by rotation of the main shaft 082. The shift drum 085 can be moved independently of the oil pump 090. Reference numerals 089L and 089R in FIG. 10 denote left and right side covers.

In the engine illustrated in the first example of the conventional art shown in FIGS. 6–8, the centrifugal start clutch 075 has been provided at a front end of the crankshaft 020, and a multi-disk type shift clutch 076 has been provided at a front end of the main shaft of the transmission (refer to FIG. 6). Further, the oil pump 040 has been provided at a front end of the balance shaft 030. In order to enhance performance of a conventional engine, a torque converter is provided in place of the conventional centrifugal start clutch 075. Further, in order to make an engine water cooled, a water pump is provided. When installing a double rotor type oil pump having a first rotor for feeding lubricating oil to a lubricating section and a second rotor for feeding lubricating oil to an oil cooler, the torque converter with a large diameter has occupied a space in front of the balance shaft. The space is insufficient as an installing place for the oil pump and the water pump. The oil pump and the water pump cannot be installed in front of the conventional balance shaft. Therefore, the width of the engine must be enlarged when positions of the balance shaft and the pump shaft, or the position of merely of the pump shaft, are moved laterally outward so as to avoid the torque converter.

In the engine illustrated in the second embodiment of the conventional art shown in FIGS. 9 and 10, the oil pump 090 is installed utilizing a dead space of an inner section of the crankcase, and the oil pump 090 is driven by the gear 097 outside the crankcase. If this arrangement is applied to an engine for a vehicle where a double rotor type oil pump is installed inside the crankcase, there is a drawback that for reasons of installing the oil pump inside the crankcase and having respectively oil delivery piping coming out from both rotors, the piping inside the crankcase becomes complicated. Since the gear 097 for driving the oil pump is provided along an outer face of the crankcase, the piping to the oil cooler of an outer section cannot be made straight. Further, there is a drawback that an arrangement of piping of an oil delivery route becomes further complicated when the water pump and the oil pump are coaxially arranged in order to form an engine of the water cooled type.

SUMMARY OF THE INVENTION

The present invention is directed to an engine with a torque converter, a double rotor type oil pump, and a water pump. Installation of the oil pump and the water pump is made possible by effectively utilizing the dead space at a bottom section of the engine on an outer side of the crankcase. In the present invention, the position of the oil pump is moved largely from the conventional position. Further, the length of the piping to the oil cooler and the radiator arranged in the front of the vehicle body is made to be as short as possible.

The present invention solves the problems described above, and relates to an engine with the torque converter. In the engine, the crankshaft is placed substantially in parallel to a longitudinal direction of a vehicle, and the shift drum is placed substantially in parallel to a longitudinal direction of the vehicle at a lower center section of the crankcase, and they are rotatably supported on the crankcase. Further, the torque converter is provided on one end of an extension section of the crankshaft at an outer section of the crankcase.

The oil pump is overlapped with the shift drum and the torque converter when viewed from a forward direction of the engine. The oil pump has a pump shaft in parallel to the crankshaft, and is driven by chains from the crankshaft. The oil pump is arranged in a space between an outer surface of the crankcase and the torque converter viewed in a longitudinal direction.

Since the oil pump is directly driven by a chain from the crankshaft, its position can be set independently from the other shafts. Further, piping to the oil cooler arranged in a front section of the vehicle can be made as short as possible.

In an engine with the torque converter as described above, a water pump coaxially driven by the oil pump is provided on an extension line of a shaft of the oil pump, on a side far from the torque converter as viewed from the center of the engine. Since the water pump is coaxially driven by the oil pump, a drive mechanism is simple. Since there is no equipment to get in the way of piping in front of the water pump, the length of piping to a radiator or the like arranged in a front section of the vehicle can be made as short as possible.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
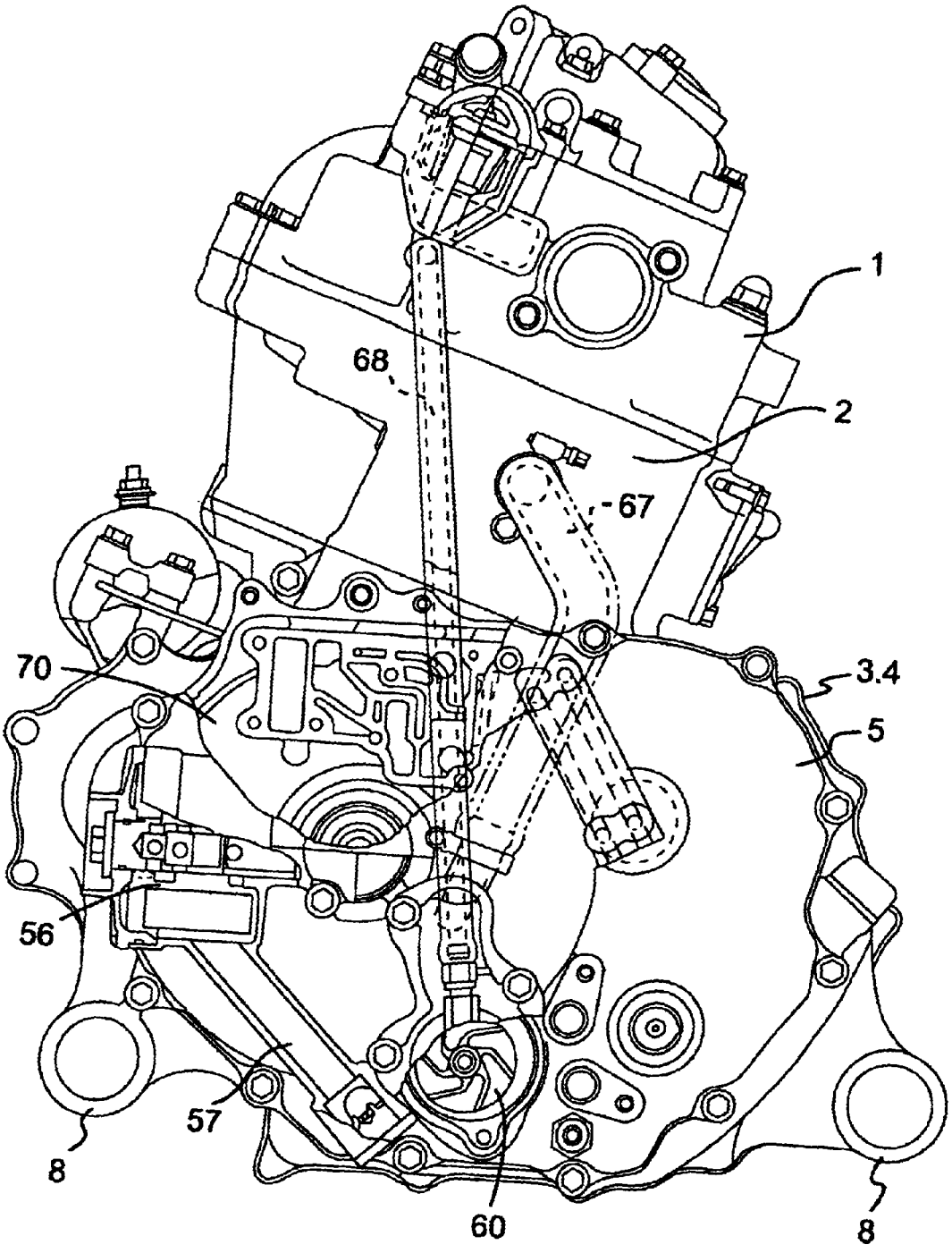
FIG. 1 is an elevational view of an engine relating to one embodiment of the present invention.
Figure 2:
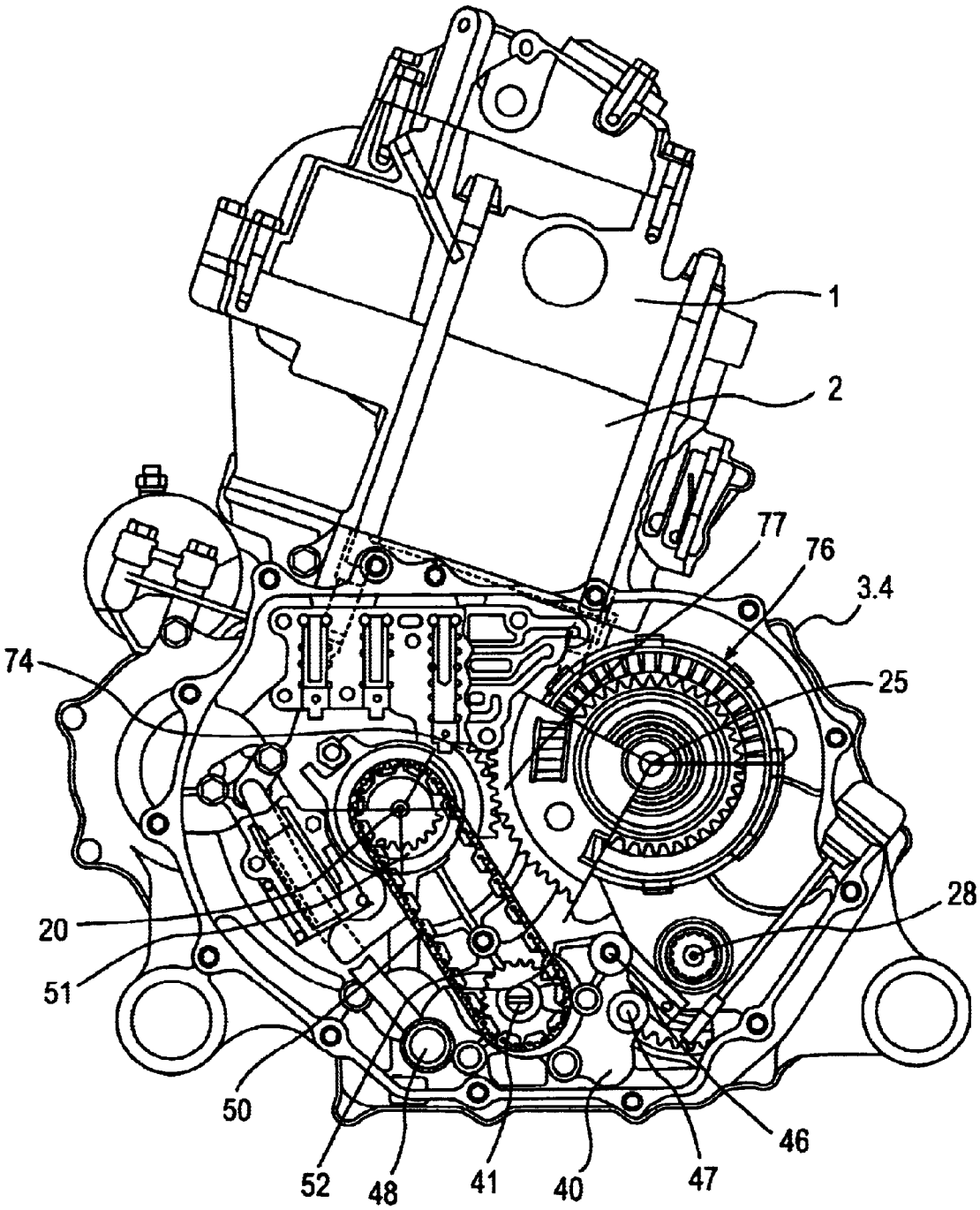
FIG. 2 is an elevational view of the engine in which a front case cover is removed.

In FIGS. 1 and 2, reference numeral 3 denotes a front crankcase, 4 denotes a rear crankcase, and respective rotation axes are supported rotatably on these crankcases 3,4. Reference numeral 2 denotes a cylinder block coupled on the front and rear crankcases 3,4 which are integrally coupled with each other, and reference numeral 1 denotes a cylinder head coupled on the cylinder block 2. This engine has a transmission case integrated with the crankcase. A crankshaft and a transmission shaft group are rotatably supported on the crankcase at an approximately central section of a vehicle, and are arranged approximately in parallel to an advancing direction of the vehicle.

Figure 3:
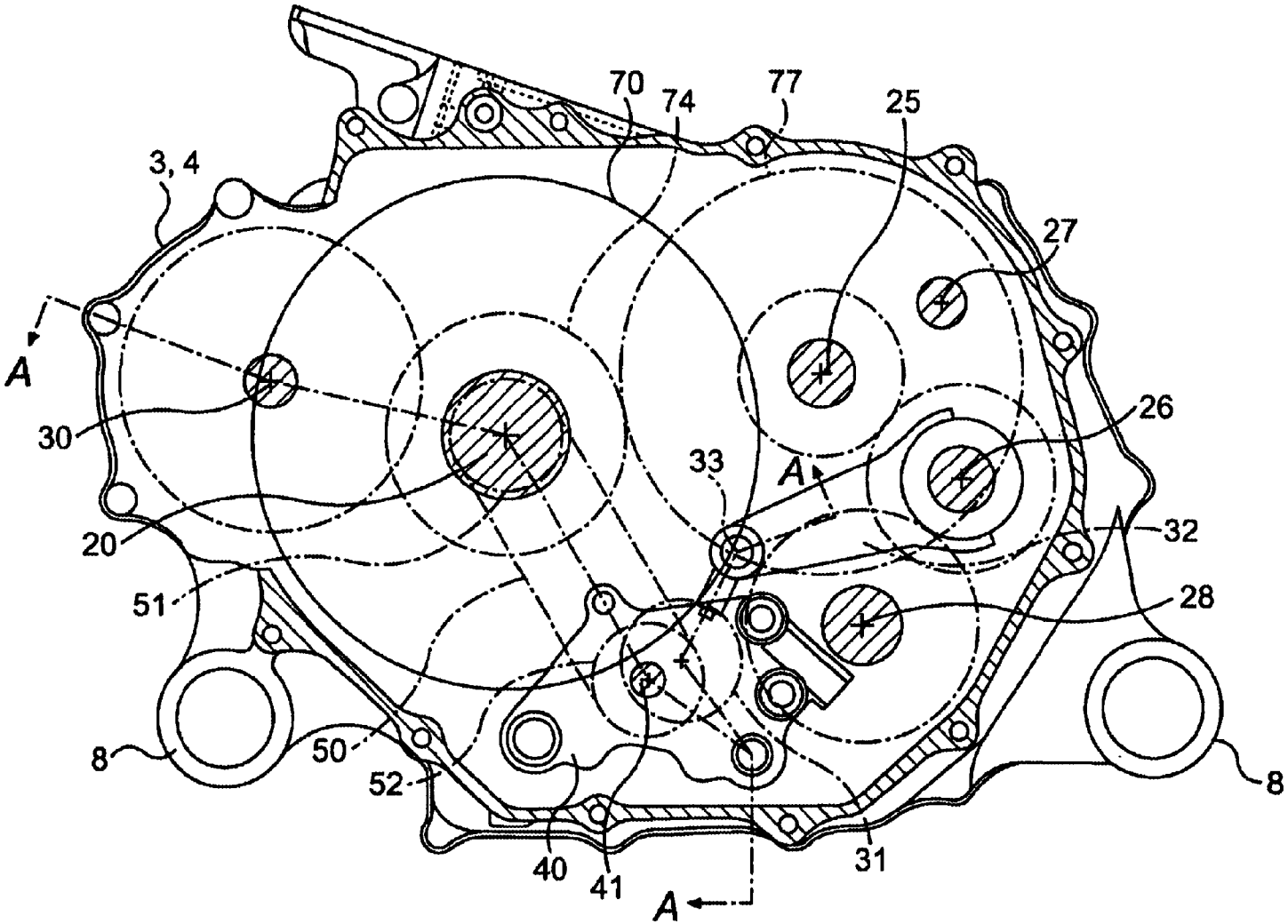
FIG. 3 is a transverse cross section of a crankcase of the engine, seen from the front.

In FIG. 3, a crankshaft 20 is arranged slightly to a left side of the center of the crankcase, viewed from a front, and extends along a traveling direction of the vehicle. The crankshaft 20 is connected by a connecting rod to a piston vertically moving inside the cylinder block, and is driven by movement of the piston. A main shaft 25 and a countershaft 26 of a transmission are arranged in that order to the right of the crankshaft 20. A reverse shaft 27 is arranged above and approximately mid-way between the main shaft 25 and the countershaft 26. A drive shaft 28 is arranged below the countershaft 26. These shafts are rotatably supported on the front crankcase 3 and the rear crankcase 4 parallel to the crankshaft 20.

A balance shaft 30 driven by gears is arranged leftward of the crankshaft 20. A shift drum 31 is arranged below the main shaft 25, and leftward of the drive shaft 28. The position of the shift drum 31 is at a central lower section on an inside of the crankcase. These shafts are rotatably supported on the front crankcase 3 and the rear crankcase 4. In FIG. 3, an outer periphery of a torque converter 70 provided at a front end of the crankshaft 20 is illustrated. Reference numeral 32 denotes a shift fork, and 33 denotes a shift fork retaining shaft. Reference numeral 40 denotes an oil pump, and 41 denotes a pump shaft of the oil pump 40. Reference numeral 50 denotes a chain for driving the pump shaft 41 from the crankshaft 20, and 51 denotes a sprocket on a side of the crankshaft 20 for suspending the chain 51. Reference numeral 52 denotes a sprocket on a side of the pump shaft 41. A positional relationship of the torque converter 70, the oil pump 40, and their related members will be described hereinafter.

Figure 4:
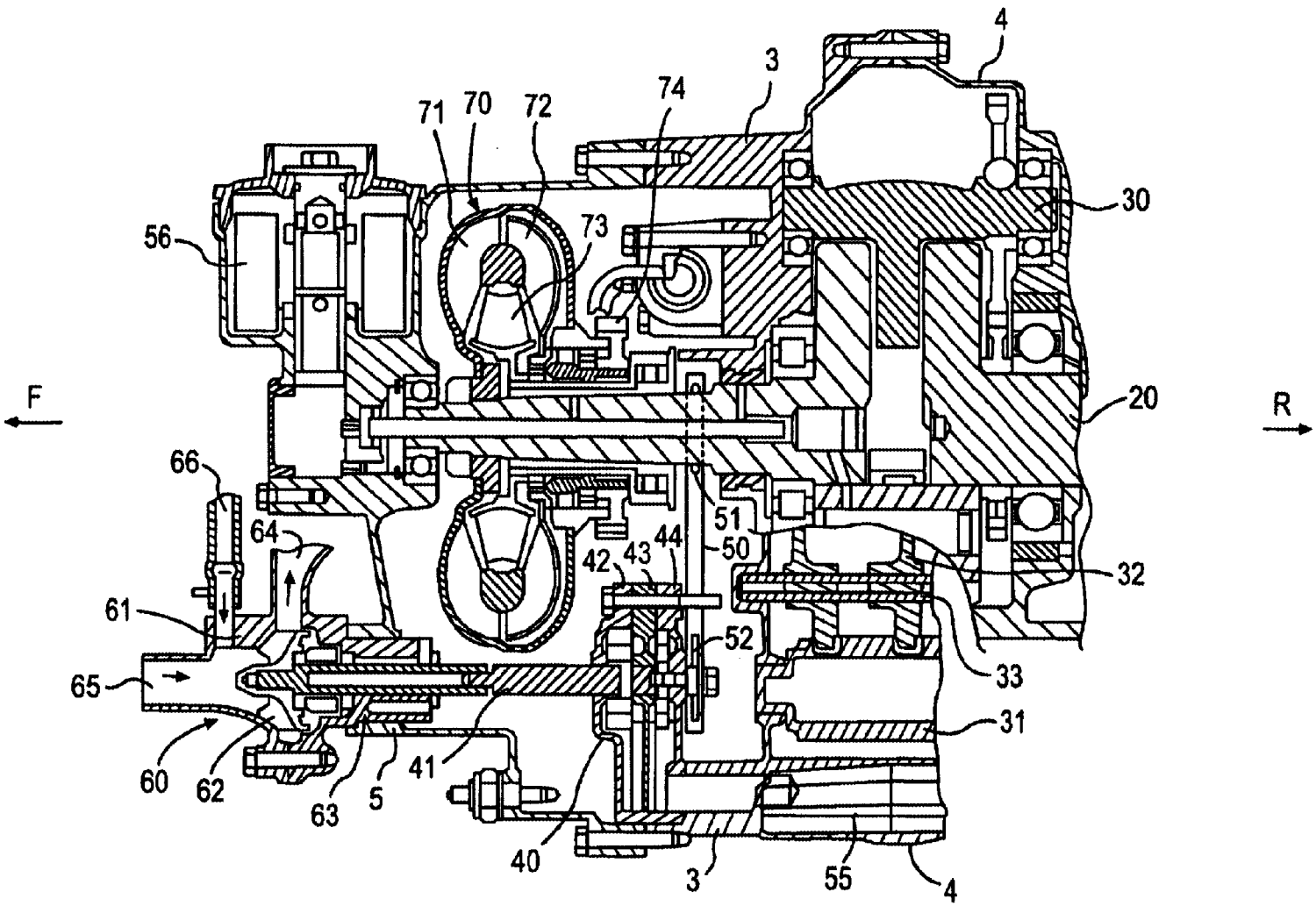
FIG. 4 shows a sectional view taken along line A—A of FIG. 3.
Figure 5A:
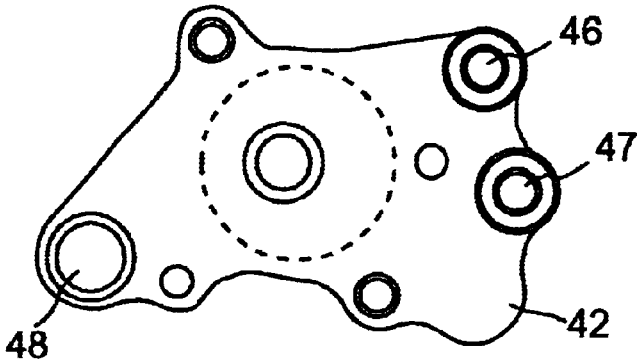
FIGS. 5(*a*)–5(*d*) are exploded views illustrating an oil pump main body utilized in the embodiment, where FIG. 5(*a*) is an elevational view of a front body, FIG. 5(*b*) is an elevational view of a central body, FIG. 5(*c*) is a perspective view of a reverse face of the central body, and FIG. 5(*d*) is an elevational view illustrating a rear body.
Figure 5B:
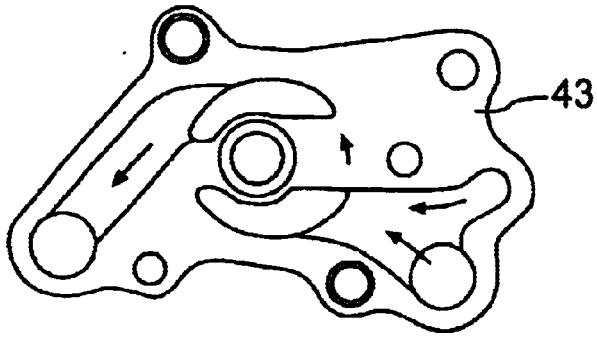
Figure 5C:
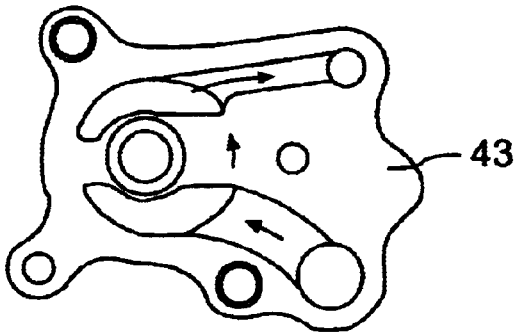
Figure 5D:
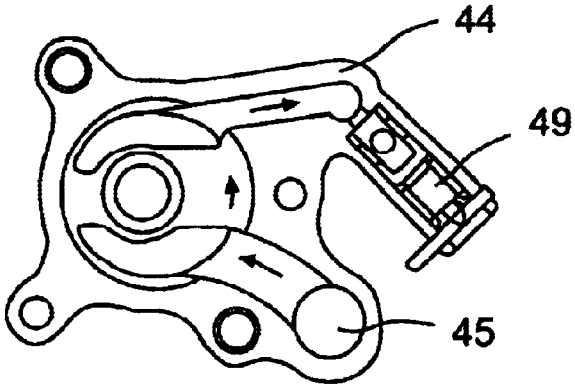
Figure 6:
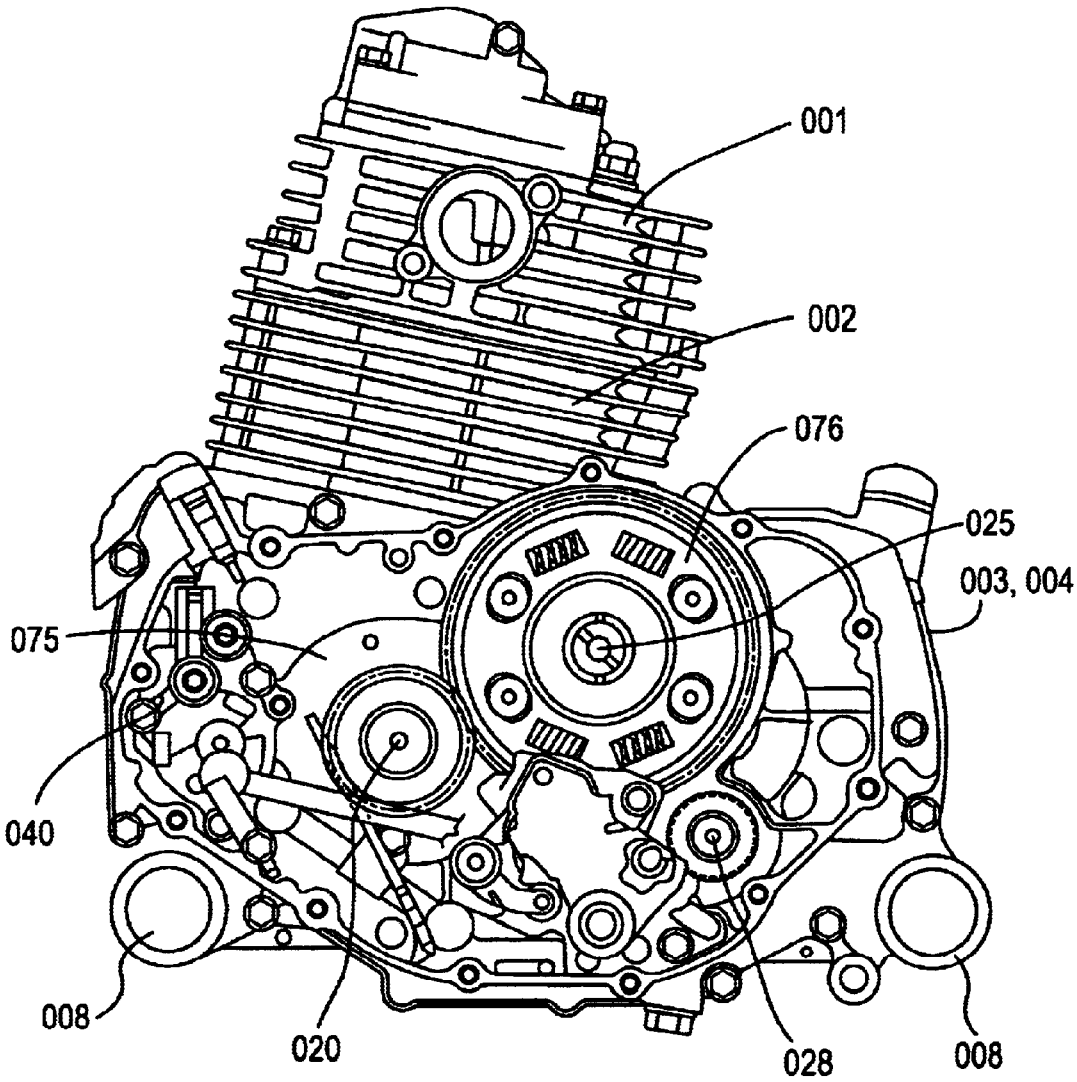
FIG. 6 BACKGROUND ART
FIG. 6 is an elevational view illustrating an engine for a vehicle relating to a first example of the conventional art.
Figure 7:
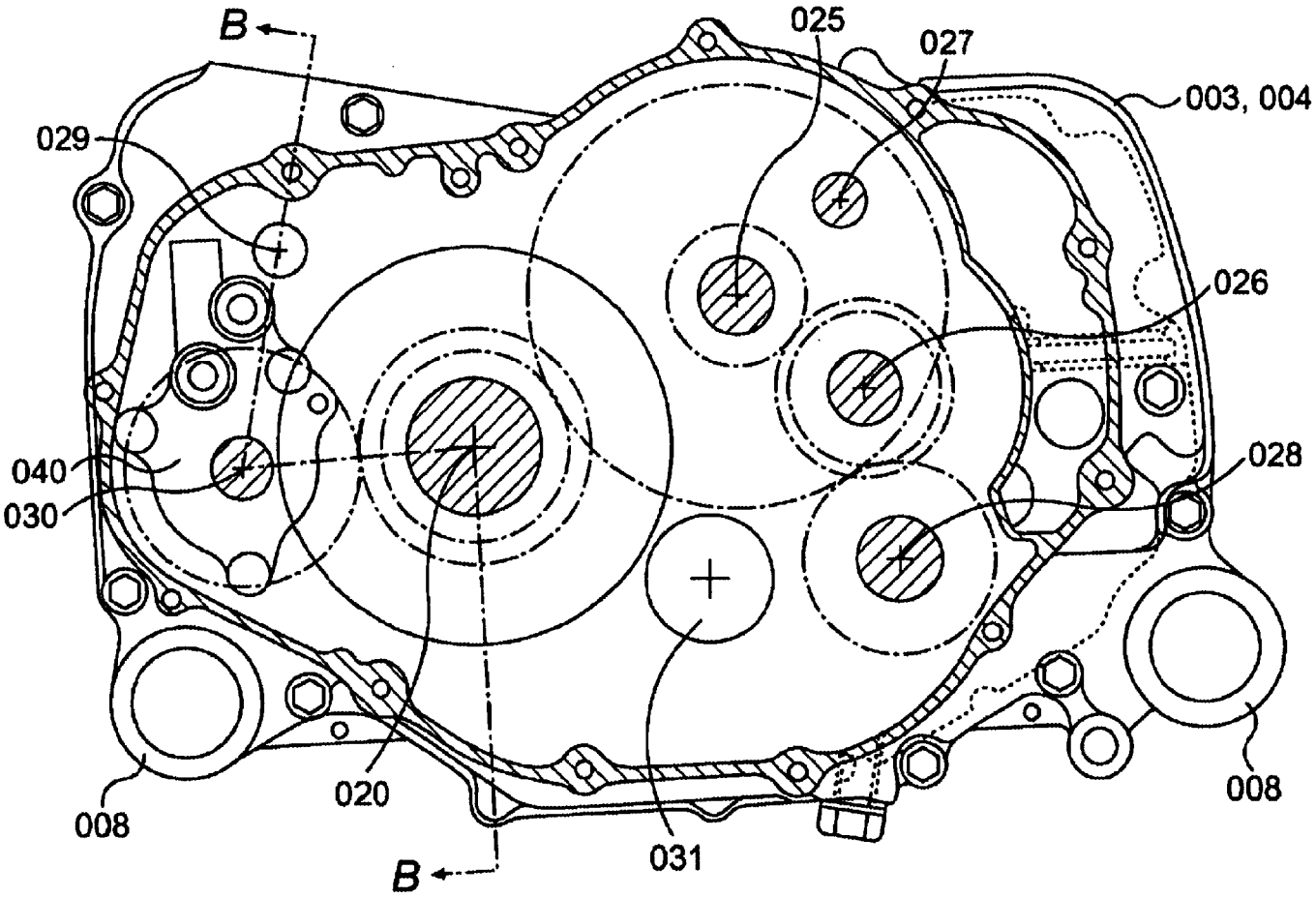
FIG. 7 BACKGROUND ART
FIG. 7 is a transverse cross section of a crankcase of the engine of FIG. 6, as viewed from the front.
Figure 8:
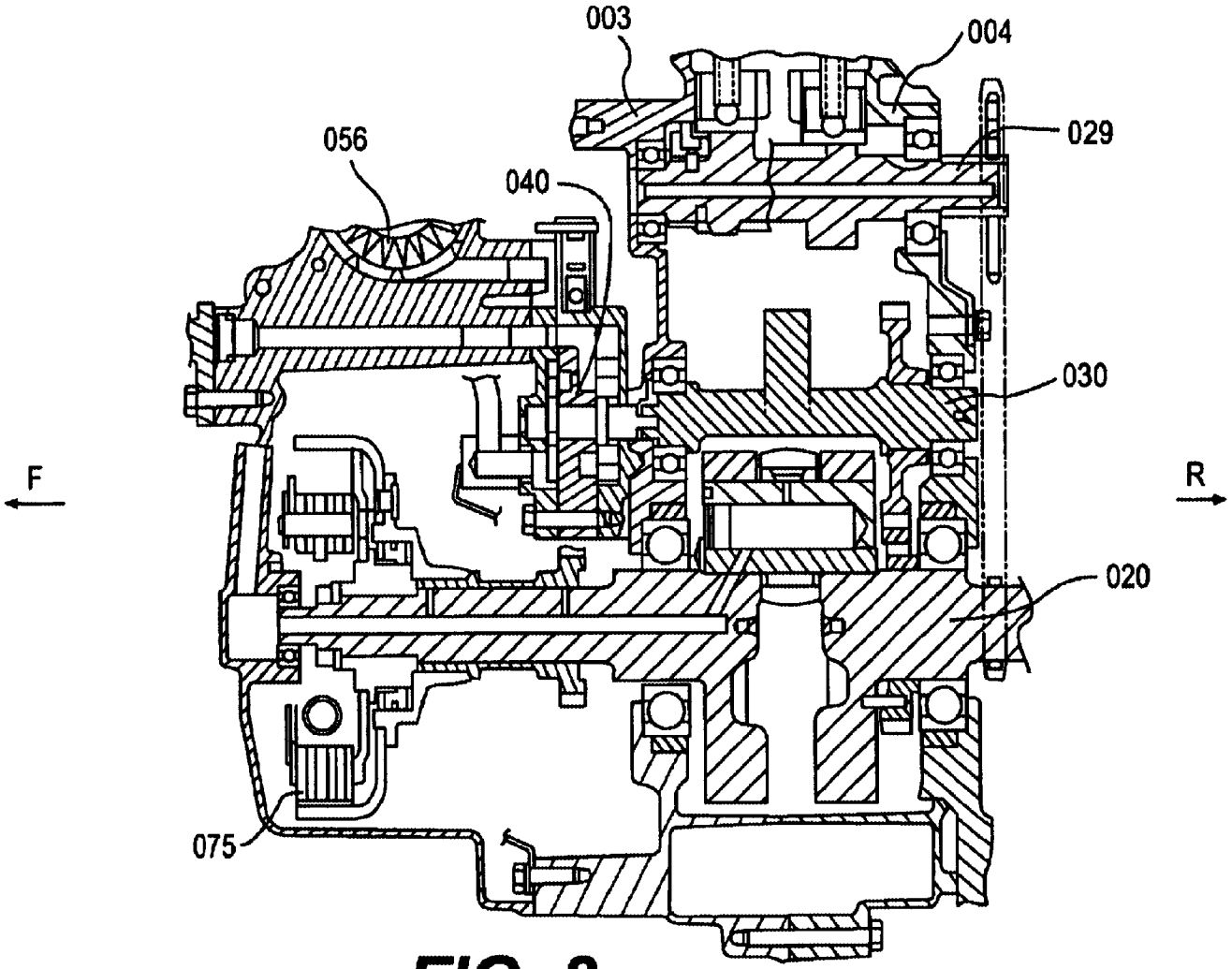
FIG. 8 BACKGROUND ART
FIG. 8 is a sectional view taken along line B—B of FIG. 7.
Figure 9:
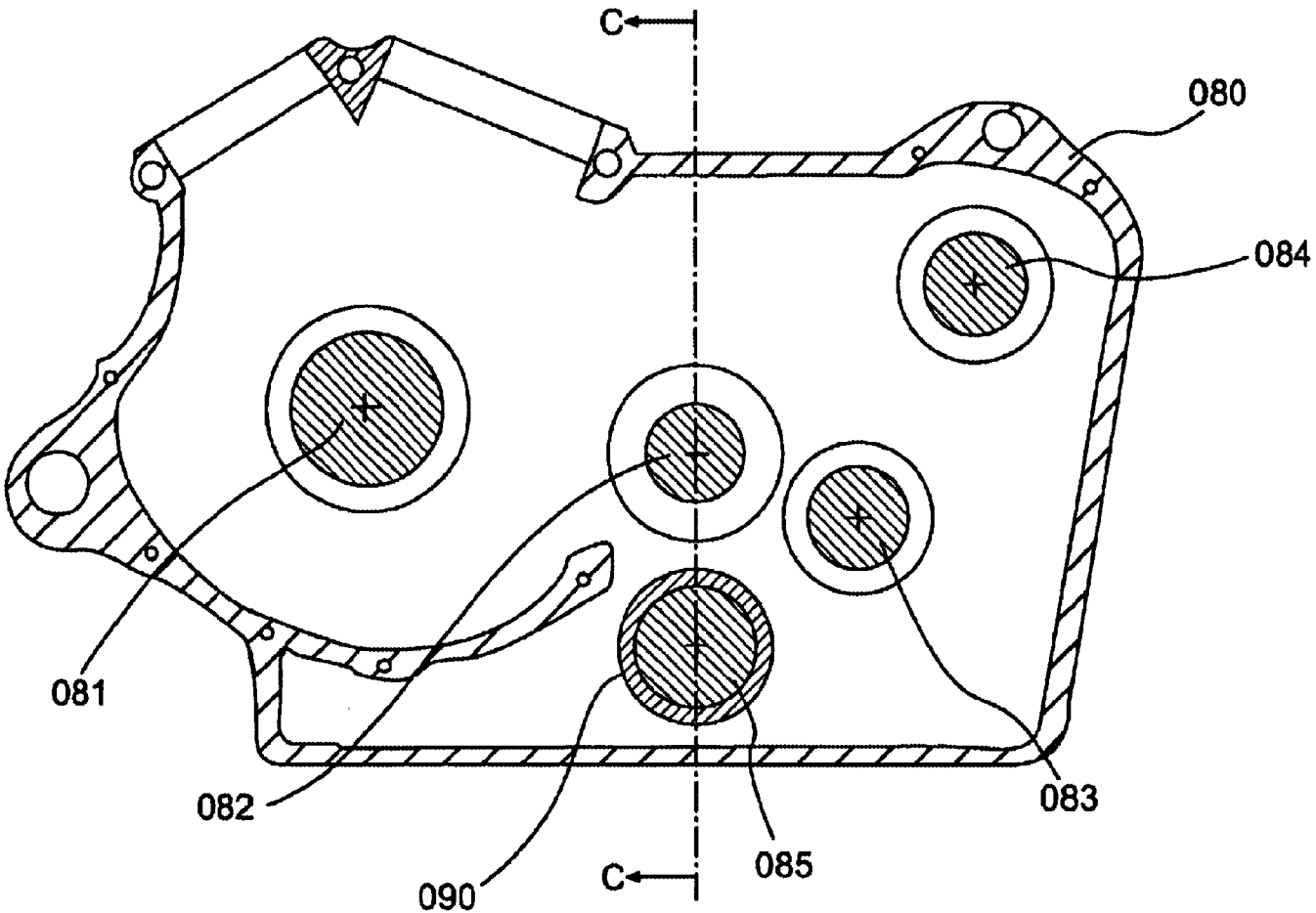
FIG. 9 BACKGROUND ART
FIG. 9 is a transverse side view illustrating a longitudinal cross section of a crankcase of a V-type engine for a motorcycle relating to a second example of the conventional art.
Figure 10:
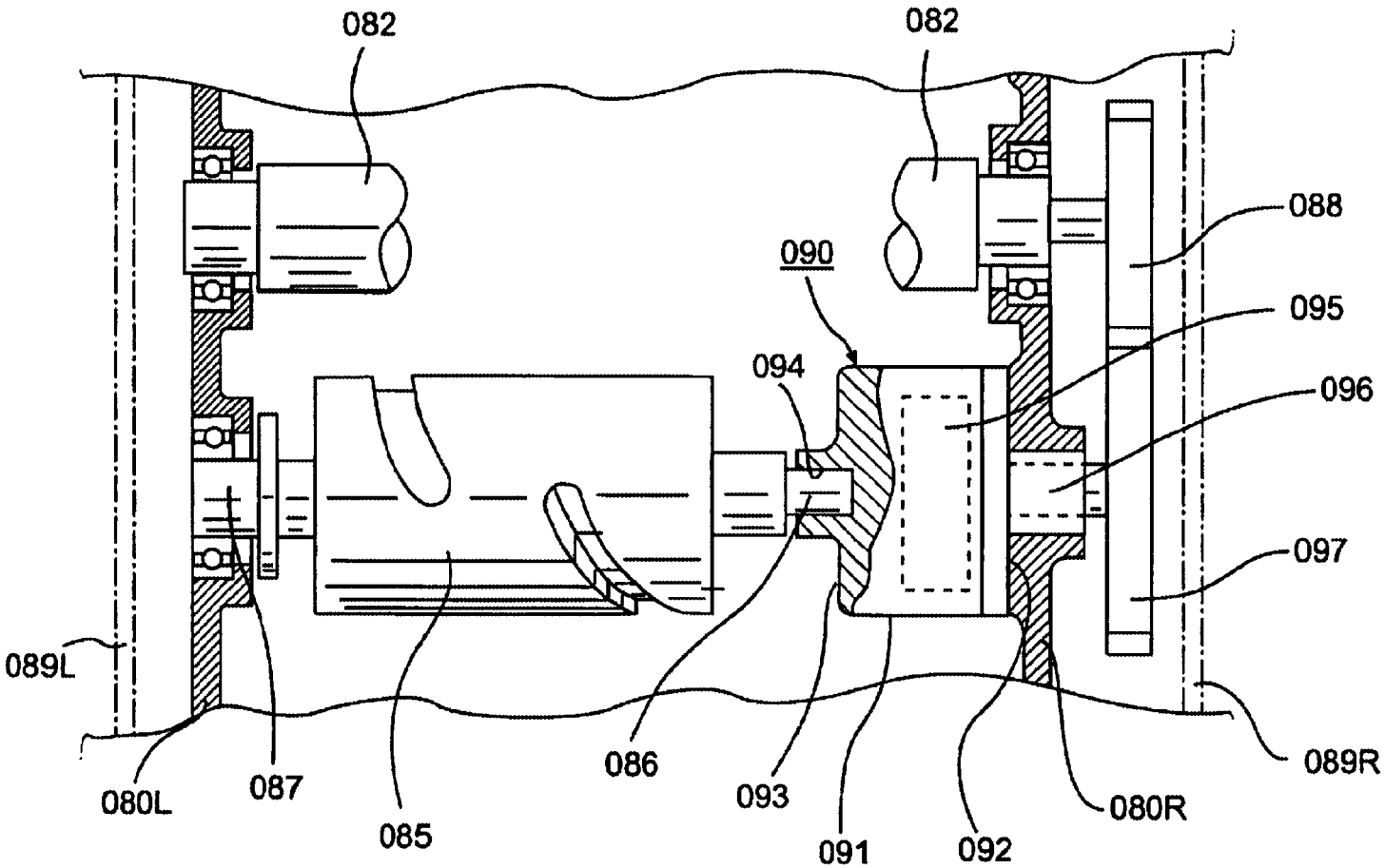
FIG. 10 BACKGROUND ART
FIG. 10 is a sectional view taken along line C—C of FIG. 9.

FIG. 4 shows a view illustrating a cross section taken along line A—A of FIG. 3. In a normal mounting state where this engine is mounted on a vehicle, a leftward direction in FIG. 4 is situated toward the front of the vehicle, and a rightward direction in FIG. 4 is situated toward the rear of the vehicle. In FIG. 4, among the shafts or the like supported on the crankcase, the crankshaft 20, the balance shaft 30 and the shift drum 31 are illustrated. The torque converter 70 is provided at an end section of an extension portion of the crankshaft 20 exterior of the crankcase. In this torque converter 70, according to a rotation of the crankshaft 20, the rotation rotates a pump shell 71 of the torque converter connected to the crankshaft 20, drives a turbine runner 72, and an output gear 74 of the torque converter 70 connected to the turbine runner 72 is brought in mesh with an input gear 77 of a multi-disk type clutch 76 provided at an end section of the main shaft of the transmission and drives the clutch 76 (refer to FIG. 2 or FIG. 3). Reference numeral 73 denotes a stator.

In FIG. 4, the oil pump 40 is located at a position approximately forward of the shift drum 31 in front of the front crankcase 3, and at a position rearward of the torque converter 70. A pump main body is fastened to the front crankcase 3. The pump main body includes three body pieces, those being a front body 42, a central body 43, and a rear body 44. A pump shaft 41 passes through the oil pump 40, and a rotor is directly driven from the crankshaft 20 via the chain 50. Reference numeral 51 denotes the sprocket on the crankshaft 20 suspending the chain 50, and 52 denotes the sprocket on the pump shaft 41, which is the same as the sprocket 51 on the crankshaft 20. Since the sprocket 52 and the chain 50 are arranged on a rear side of the oil pump 40, they are not in the way of an installation of oil delivery piping or the like, which is located in a front side of the oil pump 40.

The torque converter 70 and the oil pump 40 are covered by a front case cover 5. The front case cover 5 is screwed to the front crankcase 3. Reference numeral 55 denotes a strainer. Oil returned after lubricating respective lubricating sections is suctioned to the oil pump 40 from a passage by way of the strainer 55, further passing through the front crankcase 3. Reference numeral 56 denotes an oil filter. Oil fed to the lubricating section from the oil pump 40 goes out by way of the oil filter 56.

FIG. 5 shows an exploded view of a pump main body of the double rotor type oil pump 40 described above, wherein an illustration of the trochoid rotor is omitted. FIG. 5 (*a*) shows an elevational view of the front body 42, FIG. 5 (*b*) shows an elevational view of the central body 43, FIG. 5 (*c*) shows a perspective view of the rear surface of the central body 43, and FIG. 5 (*d*) shows an elevational view of the rear body 44. Reference numeral 45 denotes an oil inlet from the strainer 55, and 46 denotes an oil outlet heading toward the oil cooler. Reference numeral 47 denotes an oil inlet from the oil cooler, 48 denotes an oil outlet heading toward the oil filter 56, and 49 denotes a relief valve for the oil cooler.

Oil returned after lubricating respective lubricating sections inside of the engine is accumulated in the oil pump 40 at a bottom section of the crankcase. This oil is sucked from the inlet 45 on the rear body side of the oil pump 40 by way of the strainer 55 (FIG. 4) and by way of a passage passing through the front crankcase 3. A portion of the sucked oil is fed to the oil cooler (not illustrated) from the outlet 46 by the rotor on the rear body side and cooled, and returned through the inlet 47. Since the oil cooler is provided in a front section of the vehicle, the outlet 46 for oil heading toward the oil cooler and the inlet 47 for oil returning from the oil cooler are provided on a front surface of the oil pump 40.

A remaining portion of the oil sucked by way of the strainer 55 is mixed with oil returning to the oil pump 40 after being cooled by way of the oil cooler. The mixed oil is fed to the oil filter 56 from the outlet 48 on the front body side by the rotor on the front body side of the oil pump 40, and fed to respective lubricating sections after passing through the oil filter 56. Since the oil filter 56 is provided at a front section of the engine, the outlet 48 for oil heading toward the oil filter 56 is provided on a front side of the oil pump 40.

Reference numeral 57 in FIG. 1 denotes an oil feeding pipe heading toward the oil filter 56. In all the piping connected to the oil cooler and the oil filter 56, since there is no equipment to obstruct piping in a front face of the oil pump 40, the installation of the piping can be performed with the shortest distance.

As shown in FIG. 4, a water pump 60 adjoining to forward the oil pump 40 described above, further passing through the front case cover 5 is provided. A position of this water pump 60 is situated more forward than the torque converter 70. A casing 61 of the water pump 60 is passed through the front case cover 5 described above, and is fastened to the front case cover 5. An impeller 62 of the water pump 60 is driven by a water pump shaft 63 connected to a rear portion of the impeller 62. The water pump shaft 63 is located on an inner side of the front case cover 5 and is connected to the oil pump shaft 41. The water pump shaft 63 is integrally formed with the oil pump shaft 41 and rotatably driven therewith, so that the feeding of cooling water to the engine is performed.

An outlet 64 and two inlets 65 and 66 for water are provided on a front side of the water pump 60, in front of the front case cover 5. As shown in FIG. 1, a feed water pipe 67 delivers water to the cylinder block 2, and a return water pipe 68 returns water from the cylinder head 1. The feed water pipe 67 and the return water pipe 68 are located on a front side of the engine. A radiator (not illustrated) is provided at a front section of the vehicle. Since the water inlets and outlet of the pump are provided in front of the front case cover, and there is no equipment to obstruct the installation of the water pipes connected to the water pump on the periphery thereof, all the water pipes are may be installed with the shortest distance.

To enhance the performance of a conventional engine for a vehicle to become a high performance engine, a torque converter is provided in place of a centrifugal start clutch at a front end section of the crankshaft. In this state, the large diameter of the torque converter gets in the way when attempting to connect a double rotor type oil pump and a water pump coaxially at a position where the conventional oil pump resides in front of a conventional balance shaft, and so these pumps cannot be installed. When an axial arrangement is moved laterally outward so as to avoid the torque converter, the width of the engine becomes large. When the width of the engine is not enlarged, another appropriate pump installation place must be determined. An alternative arrangement where the pump is located at an inner side space of the crankcase leads to undesirable complexity of the associated piping.

In a conventional engine, a space located on the outside of the crankcase and forwardly of the shift drum has been a dead space. In the present invention, the oil pump in front of the conventional balance shaft is eliminated. Instead, a double rotor type oil pump 40 driven by a chain 50 directly from a crankshaft 20 is installed outside of the crankcase at a lower central section of the engine at a position approximately coaxial with the shift drum 31, and in a space between an outer surface of the front crankcase 3 and the torque converter 70. In addition, a water pump 60 coaxially driven by the oil pump 40 is installed in front of the oil pump 40.

In the present invention, an oil pump in front of the balance shaft is eliminated. Instead, the oil pump is moved and installed at a place having no effect on the width of the engine, and the engine thus becomes compact by narrowing the width of the engine.

In the present invention, by placing an installation position of the oil pump and the water pump on an outside of the crankcase at a lower center section of the engine, and by driving these pumps from the crankshaft on a rear side of the pump, there is no obstacle for installation of piping on a front side of the pump. Accordingly, the piping to and from an oil cooler or a radiator located at a front section of the vehicle can be made the shortest dimension, and a compact engine mounting arrangement on the vehicle can be realized.

In the present invention, since the oil pump and the water pump are installed so as to be overlapped with a part of torque converter when viewed from the front of the engine, an arrangement in the neighborhood of the pump at a lower section of the engine can be made compact.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An engine with a torque converter comprising:

a crankshaft placed approximately in parallel to a longitudinal direction of a vehicle and supported rotatably on a crankcase;

a shift drum placed at a central lower section of the crankcase approximately in parallel to the longitudinal direction of a vehicle and supported rotatably on the crankcase; and a torque converter at one end of an extension section of the crankshaft to an outer section of the crankcase, wherein a part of an oil pump is overlapped with the shift drum and the torque converter when viewed perspectively from a forward direction of the engine, and wherein the oil pump has a pump shaft in parallel to the crankshaft, a water pump being disposed on an extension line of the pump shaft, wherein chains from the crankshaft drive the pump shaft, thus driving both the oil pump and the water pump, and wherein the oil pump is arranged in a space between an outer surface of the crankcase and the torque converter in a longitudinal direction, and the water pump is disposed forwardly of the torque converter.

2. The engine with a torque converter according to claim 1, wherein the pump shaft is disposed in the crankcase at a level lower than a level of the crankshaft.

3. An engine comprising:

a crankcase;

a crankshaft rotatably supported by said crankcase;

a shift drum located at a central lower section of said crankcase, said shift drum being rotatably supported by said crankcase;

a torque converter located at one end of said crankshaft, said torque converter being located outside of said crankcase;

an oil pump located outside of said crankcase forwardly of said shift drum and rearwardly of said torque converter, said oil pump including an oil pump shaft;

a water pump disposed forwardly of the torque converter, the water pump being disposed on an extension line of a shaft of the oil pump and being driven by the oil pump; and a flexible drive member interconnecting said crankshaft with said oil pump shaft, said flexible drive member being located in a space between said crankcase and said torque converter.

4. The engine according to claim 3, wherein said oil pump shaft extends parallel to said crankshaft.

5. The engine according to claim 3, wherein said flexible drive member is a chain.

6. The engine according to claim 3, further comprising a first sprocket attached to said crankshaft, and a second sprocket attached to said oil pump shaft.

7. The engine according to claim 6, wherein said flexible drive member is a chain entrained around said sprockets.

8. The engine according to claim 3, wherein said oil pump includes a first rotor and a second rotor.

9. The engine according to claim 3, wherein said oil pump includes a pump body comprising:

a front body;

a rear body; and a central body located between said front body and said rear body.

10. The engine according to claim 9, wherein said oil pump includes a first rotor located between said front body and said central body, and a second rotor located between said central body and said rear body.

11. The engine according to claim 3, wherein a water pump shaft and said oil pump shaft are disposed at a level lower in the crankcase than a level of the crankshaft.

12. The engine according to claim 11, wherein said oil pump includes a pump body comprising:

a front body;

a rear body; and a central body located between said front body and said rear body.

13. The engine according to claim 12, wherein said oil pump includes a first rotor located between said front body and said central body, and a second rotor located between said central body and said rear body.

14. The engine according to claim 13, further comprising a first sprocket attached to said crankshaft, and a second sprocket attached to said oil pump shaft.

15. The engine according to claim 14, wherein said flexible drive member is a chain entrained around said first sprocket and said second sprocket.

16. The engine according to claim 15, wherein said second sprocket is attached to one end of said oil pump shaft, and said water pump shaft is attached to an opposite end of said oil pump shaft.

17. The engine according to claim 16, Wherein said oil pump shaft and said water pump shaft each extend parallel to said crankshaft.

18. A vehicle comprising:

a body; and an engine, said engine including:

a crankcase;

a crankshaft rotatably supported by said crankcase;

a shift drum located at a central lower section of said crankcase, said shift drum being rotatably supported by said crankcase;

a torque converter located at one end of said crankshaft, said torque converter being located outside of said crankcase;

an oil pump located outside of said crankcase forwardly of said shift drum and rearwardly of said torque converter, said oil pump including an oil pump shaft;

a water pump disposed forwardly of the torque converter, the water pump being disposed on an extension line of a shaft of the oil pump and being driven by the oil pump; and a flexible drive member interconnecting said crankshaft with said oil pump shaft, said flexible drive member being located in a space between said crankcase and said torque converter.

* * * * *